US010920474B2

(12) United States Patent
Shinmura

(10) Patent No.: US 10,920,474 B2
(45) Date of Patent: Feb. 16, 2021

(54) HINGE DEVICE

(71) Applicant: Sugatsune Kogyo Co., Ltd., Tokyo (JP)

(72) Inventor: Ken Shinmura, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 6 days.

(21) Appl. No.: 16/394,910

(22) Filed: Apr. 25, 2019

(65) Prior Publication Data

US 2019/0330901 A1 Oct. 31, 2019

(30) Foreign Application Priority Data

Apr. 25, 2018 (JP) ..... JP2018-083755

(51) Int. Cl.
*E05F 1/12* (2006.01)
*E05D 3/02* (2006.01)

(52) U.S. Cl.
CPC ..... *E05F 1/1223* (2013.01); *E05D 3/02* (2013.01); *E05Y 2201/41* (2013.01); *E05Y 2201/484* (2013.01); *E05Y 2600/626* (2013.01)

(58) Field of Classification Search
CPC ..... E05F 1/1223; E05D 3/02; Y10T 16/5382; Y10T 16/53822; Y10T 16/53828; Y10T 16/5381; Y10T 16/53826
See application file for complete search history.

(56) References Cited

U.S. PATENT DOCUMENTS 864,747 A * 8/1907 Wilson ..... E05F 1/1215 16/285
870,640 A * 11/1907 Ocumpaugh ..... E05D 11/0054 16/250
941,239 A * 11/1909 Fischer ..... E05F 1/1215 16/279
1,583,842 A * 5/1926 Keene ..... E05F 1/1215 16/285
2,924,843 A * 2/1960 Tykeson ..... E05F 1/1016 16/279
3,335,454 A * 8/1967 Danster,Jr. ..... E05F 1/1215 16/278
7,210,199 B2 * 5/2007 Clark ..... E05D 5/06 16/299

(Continued)

FOREIGN PATENT DOCUMENTS

EP 0688932 B1 * 8/1999 ..... E06B 11/085
JP S62-163280 U 10/1987
JP 3023649 B2 3/2000

OTHER PUBLICATIONS

Japanese Office Action dated Jun. 2, 2020, issued in Japanese Application No. 2018-083755, 7 pages with translation.

*Primary Examiner* — Victor D Batson
*Assistant Examiner* — Matthew J Sullivan
(74) *Attorney, Agent, or Firm* — Masuvalley & Partners

(57) ABSTRACT

A hinge device is configured to apply an urging force to a case for returning the case to its neutral position. The hinge device comprises a first and a second contact portion, the case with a cylindrical portion1, a coil spring fitted in the cylindrical portion1 of the case, a shaft inserted inside the coil spring, and a shaft member having a first and a second engaging portion fixed to the shaft in anti-rotatable. The first and second contact portion are formed integral with the cylindrical portion1.

4 Claims, 10 Drawing Sheets

(56) References Cited

U.S. PATENT DOCUMENTS

| | | | | |
|---|---|---|---|---|
| 7,401,381 | B2 * | 7/2008 | Konja | E05F 1/1016 16/285 |
| 8,621,712 | B2 * | 1/2014 | Pate, Jr. | E05F 1/1207 16/280 |
| 9,009,916 | B2 * | 4/2015 | Nagl | E05F 3/20 16/256 |
| 9,206,636 | B2 * | 12/2015 | Nagl | E05F 1/1215 |
| 9,631,410 | B2 * | 4/2017 | Nakao | E06B 3/481 |
| 9,856,686 | B2 * | 1/2018 | Bacchetti | E05F 3/20 |
| 10,633,905 | B2 * | 4/2020 | Feng | E05F 1/1223 |
| 2004/0093689 | A1 * | 5/2004 | Sosa | E05D 7/04 16/301 |
| 2005/0177975 | A1 * | 8/2005 | Wang | E05F 3/04 16/60 |
| 2015/0233164 | A1 * | 8/2015 | Bacchetti | E05F 1/1223 16/54 |
| 2017/0030125 | A1 * | 2/2017 | Bacchetti | E05F 3/10 |
| 2018/0223574 | A1 * | 8/2018 | Babikian | E05D 11/06 |
| 2019/0330899 | A1 * | 10/2019 | Shinmura | E05F 1/1215 |
| 2019/0330900 | A1 * | 10/2019 | Shinmura | E05D 7/0027 |

* cited by examiner 10
13
15
16
16a
17
17a
18
19
23
25
27
31
33
35
9
43a
43b
43c
b
c
i
ii
iii

12

HINGE DEVICE

RELATED APPLICATIONS

This application claims priority to Japanese Patent Application No. 2018-083755 filed Apr. 25, 2018 which is hereby incorporated herein by reference in its entirety.

BACKGROUND OF THE INVENTION

Field of the Invention

The present invention generally relates to a hinge device, and more particularly to a hinge device for a type of door or the like rotatable from its neutral position to its forward and backward direction.

Description of the Background Art

For example, a counter installed in a store, a bank and others is provided with a type of door that may rotate from its neutral position to its forward and backward position. There is a gravity hinge known as a hinge device for returning the aforementioned type of door to the neutral position. The gravity hinge is provided therein a cam and is configured to use its own weight to allow the door to return to the neutral position. However, the gravity hinge has a drawback that the door keeps swinging in the vicinity of the neutral position. Thus, such hinge devices have been developed that utilize the spring force of a coil spring instead of the door weight to thereby return the door to the neutral position.

As an example of a hinge device utilizing the spring force of a coil spring, Japanese patent publication No. 3023649 discloses a hinge device which utilizes torsion of a single coil spring to return a door to its neutral position.

As shown in FIG. 11 of the accompanying drawings, the hinge device comprises a case 82 having a cylindrical portion 81, a coil spring 83 fitted in the cylindrical portion 81, and a shaft member 84 inserted inside the coil spring 83. The coil spring 83 has its opposite ends provided with a first spring holder 85 and a second spring holder 86, respectively. The case 82 is provided with a first contact pin 87 and a second contact pin 88. The shaft member 84 is provided with a first engaging pin 89 and a second engaging pin 90. At the neutral position of the case 82, the first spring holder 85 comes into contact with the first engaging pin 89 of the shaft member 84 while the second spring holder 86 comes into contact with the second engaging pin 90 of the shaft member 84 such that the coil spring 83 is twisted.

In addition to that, at the neutral position of the case 82, the first contact pin 87 of the case 82 comes into contact with the first spring holder 85, and the second contact pin 88 of the case 82 comes into contact with the second spring holder 86. When the case 82 is rotated from the neutral position to one direction (clockwise direction), the first spring holder 85 in contact with the first contact pin 87 of the case 82 is rotated in the clockwise direction. As a consequence, the coil spring 83 is twisted, thereby producing torsion in the coil spring 83 to untwist it. It allows the case 82 to return to the neutral position. When the case 82 is rotated from the neutral position in the other direction (counterclockwise direction), the second spring holder 86 in contact with the second contact pin 88 of the case 82 is rotated in the counterclockwise direction. The coil spring 83 is consequently twisted, so that the case 82 correspondingly returns to the neutral position.

In the hinge device of Japanese patent publication No. 3023649, it is required that the first spring holder 85 be in contact with the first engaging pin 89 and the first contact pin 87 at the neutral position of the case 82, while the second spring holder 86 be in contact with the second engaging pin 90 and the second contact pin 88. If there is a gap between them, the case 82 in the neutral position rattles by the extent of the gap, resulting in rattling of the door attached to the case 82. Thus, the first contact pin 87 and the second contact pin 88 of the case 82 are needed to be aligned accurately.

In the hinge device of the Japanese patent publication No. 3023649, however, for the purpose of assembling the hinge device, the case 82 is divided into three portions, namely the cylindrical portion 81, and upper and lower cap plates 91 and 92. It causes a problem that the first contact pin 87 and the second contact pin 88 of the case 82 have difficulty in alignment with each other.

SUMMARY OF THE INVENTION

It is an object of the present invention to provide a hinge device that can prevent the rattle of the case in the neutral position.

In order to overcome the difficulties stated above, one aspect of the invention is directed to a hinge device which comprises a case including a first contact portion, a second contact portion and a cylindrical portion, a coil spring fitted in the cylindrical portion of the case, a shaft inserted inside the coil spring, and a shaft member having a first engaging portion and a second engaging portion fixed to the shaft in anti-rotatable. When the case is rotated relatively from the neutral position in one direction with respect to the shaft member, one end of the coil spring in contact with the first contact portion of the case is rotated relatively in the one direction with respect to the shaft member while the other end of the coil spring comes into contact with the second engaging portion of the shaft member, thereby twisting the coil spring. When the case is rotated relatively from the neutral position in the other direction with respect to the shaft member, the other end of the coil spring in contact with the second contact portion of the case is rotated relatively in the other direction with respect to the shaft member while the one end of the coil spring comes into contact with the first engaging portion of the shaft member, thereby twisting the coil spring. The first and second contact portions are formed integral with the cylindrical portion.

In accordance with the present invention, since the first and second contact portions of the case are formed integral with the cylindrical portion, the first and second contact portions can be aligned accurately with each other. Thus, the case in the neutral position can be prevented from rattling.

BRIEF DESCRIPTION OF THE DRAWINGS

The objects and features of the present invention will become more apparent from consideration of the following detailed description taken in conjunction with the accompanying drawings in which:

FIGS. 10A through 10C schematically depict an operation of the damper structure, FIG. 10A showing a neutral position of the case, FIG. 10B showing a state where the case is rotated counterclockwise by about 90 degrees from its neutral position, and FIG. 10C showing a state where the case is rotated clockwise by about 90 degrees from its neutral position)

BRIEF DESCRIPTION OF THE PREFERRED EMBODIMENT

Hereinafter, a hinge device according to an embodiment of the present invention will be described in detail with reference to the accompanying drawings. In this regard, the hinge device of the present invention may be embodied in various aspects and is not limited to the embodiment described in this specification. The illustrative embodiment is provided with intent to sufficiently provide the disclosure in the specification for facilitating those skilled in the art to sufficiently understand the scope of the invention.

Figure 1A:
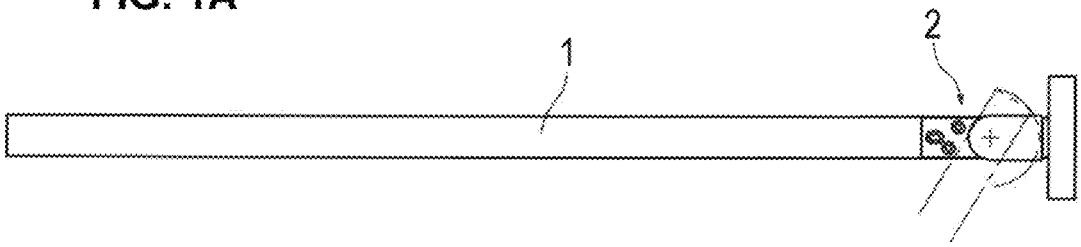
FIGS. 1A and 1B show an example of a hinge device according to an embodiment of the present invention attached to a counter door, FIG. 1A and FIG. 1B being a plan and a side view, respectively.
Figure 1B:
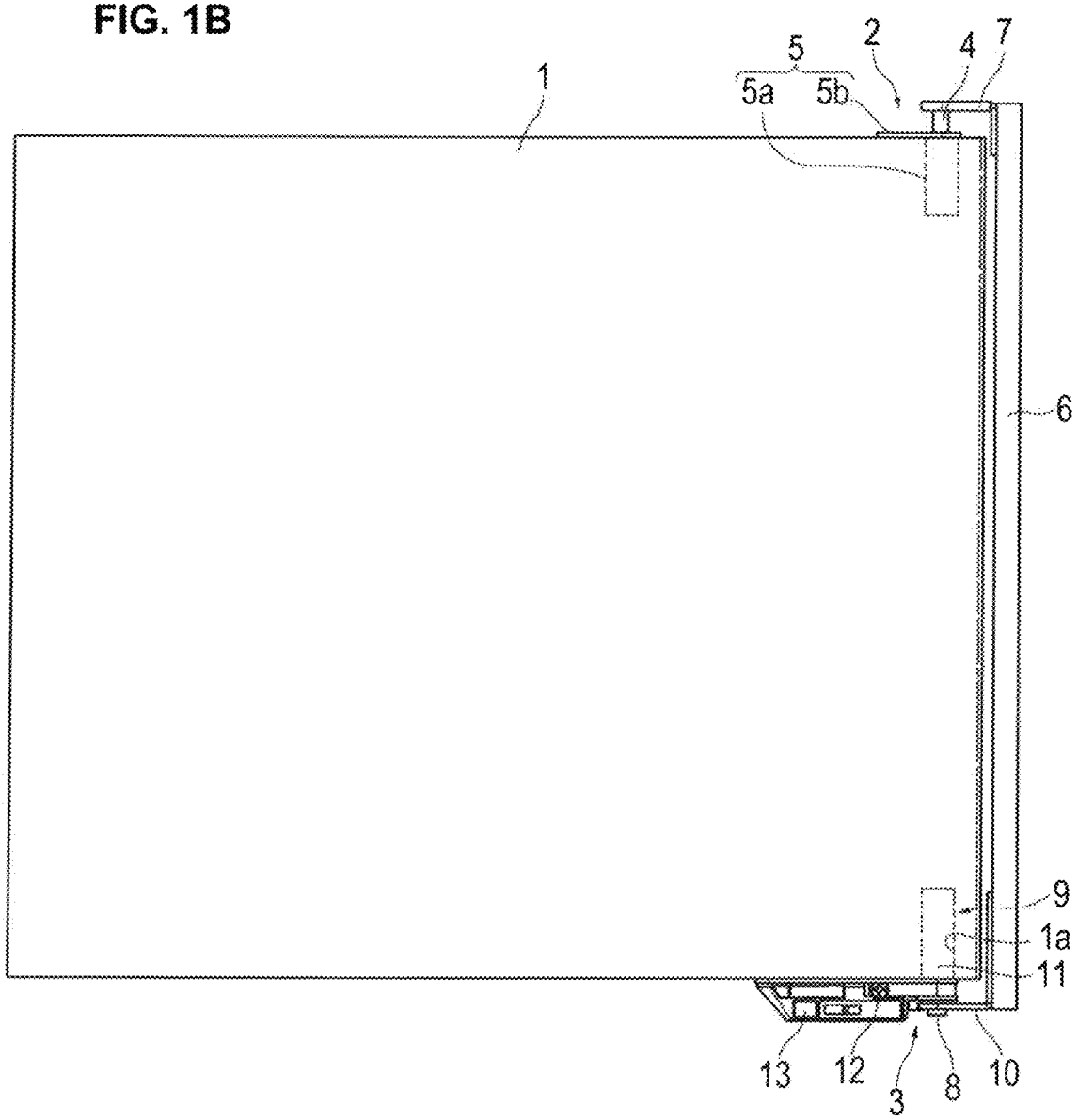

FIG. 1 shows an example of a hinge device according to an embodiment of the present invention, which is attached to a door 1, such as a counter door. FIG. 1A is a plan view and FIG. 1B is a side view. A hinge device 2 is attached to the upper part of the door. Correspondingly, another hinge device 3 is attached to the lower part of the door 1. The hinge device 3 attached to the lower part of the door 1 is a hinge device according to the present embodiment.

The hinge device 2 at the upper part of the door 1 comprises a shaft member 4 and a case 5. The shaft member 4 is attached to an L-shaped washer 7 which is attached to the upper part of a main body 6, such as a frame. The shaft member 4 is oriented vertically downward. The case 5 comprises a cylindrical portion 5*a* fitted into a hole formed in an upper surface of the door 1, and a base 5*b* attached to the upper surface of the door 1. The cylindrical portion 5*a* and the base 5*b* are integrated with each other. To the cylindrical portion 5*a*, the shaft member 4 is rotatably fitted. The door 1 is rotatable about the shaft member 4.

The hinge device 3 of the instant embodiment also comprises a shaft member 8 and a case 9. The shaft member 8 is attached to an L-shaped washer 10 which is attached to the lower part of the main body 6. The shaft member 8 is oriented vertically upward. The case 9 comprises a cylindrical portion 11 fitted into a hole formed on a lower surface of the door 1, and a base 23 attached to the lower surface of the door 1. The door 1 is rotatable about the shaft member 8.

The hinge device 3 returns the door 1, when rotated in its forward or backward direction, to its neutral position. In the hinge device 3, incorporated are a positional adjustment structure 12 for adjusting an angle of the neutral position of the door 1 and a damper structure 13 for producing a damper force when the door 1 returns to the neutral position.

Hereinafter, the configurations of the hinge device 3, the positional adjustment structure 12 and the damper structure 13 will be described in order.

[Hinge Device]

Figure 2A:
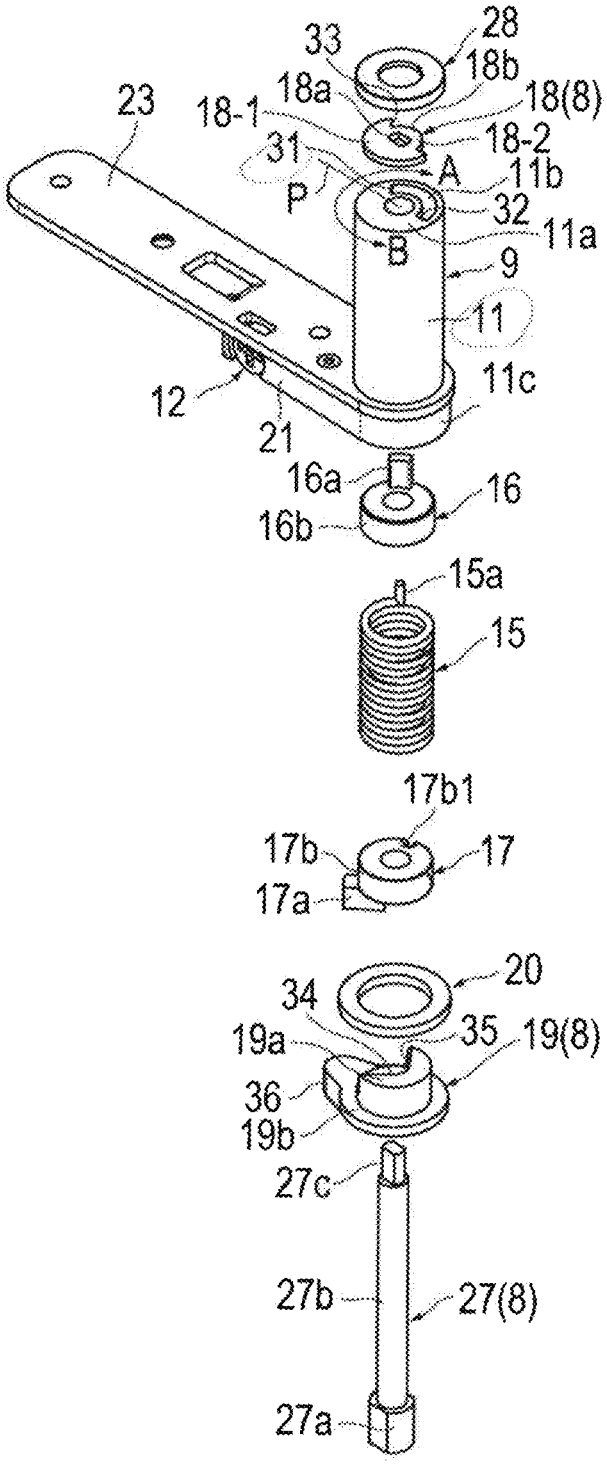
FIGS. 2A and 2B are a perspective view of the hinge device of the illustrative embodiment viewing from its top side, FIG. 2A and FIG. 2B being an exploded perspective view and a perspective view when assembled, respectively.
Figure 2B:
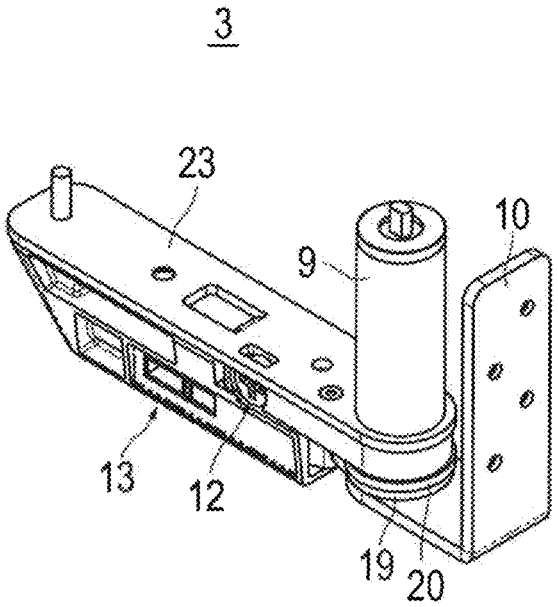
Figure 3A:
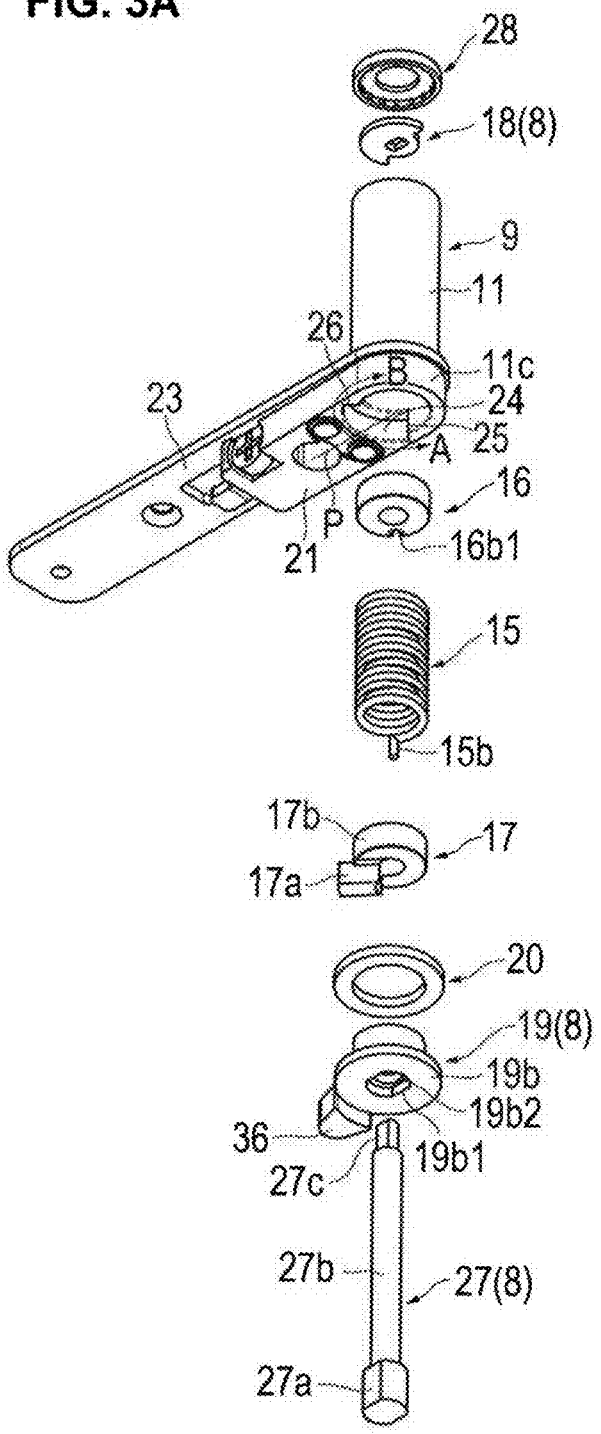
FIGS. 3A and 3B are a perspective view of the hinge device of the illustrative embodiment viewed from its bottom side, FIG. 3A and FIG. 3B being an exploded perspective view and a perspective view when assembled, respectively.
Figure 3B:
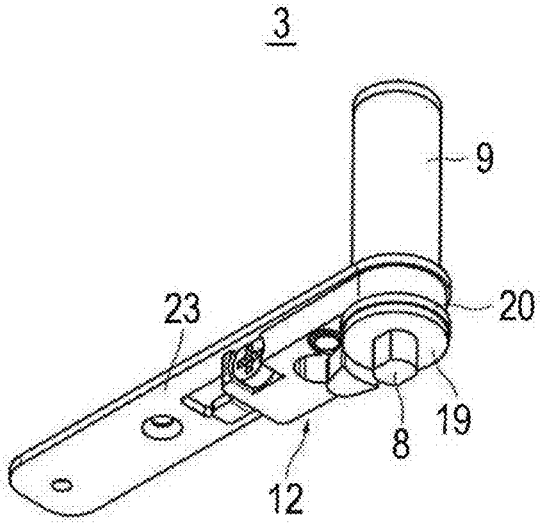

FIGS. 2A and 2B are a top side perspective view of the hinge device 3 of this embodiment, FIG. 2A being an exploded perspective view and FIG. 2B showing the assembled state thereof in a perspective view. FIGS. 3A and 3B are a bottom side perspective view of the hinge device 3 of the instant embodiment, FIG. 3A being an exploded perspective view and FIG. 3B showing an assembled state in a perspective view.

The hinge device 3 comprises the case 9, a coil spring 15, a first spring holder 16 serving as one end part of the coil spring 15, a second spring holder 17 serving as the other end part of the coil spring 15, and the shaft member 8. The configuration of those components of the hinge device 3 will be described below.

Figure 6A:
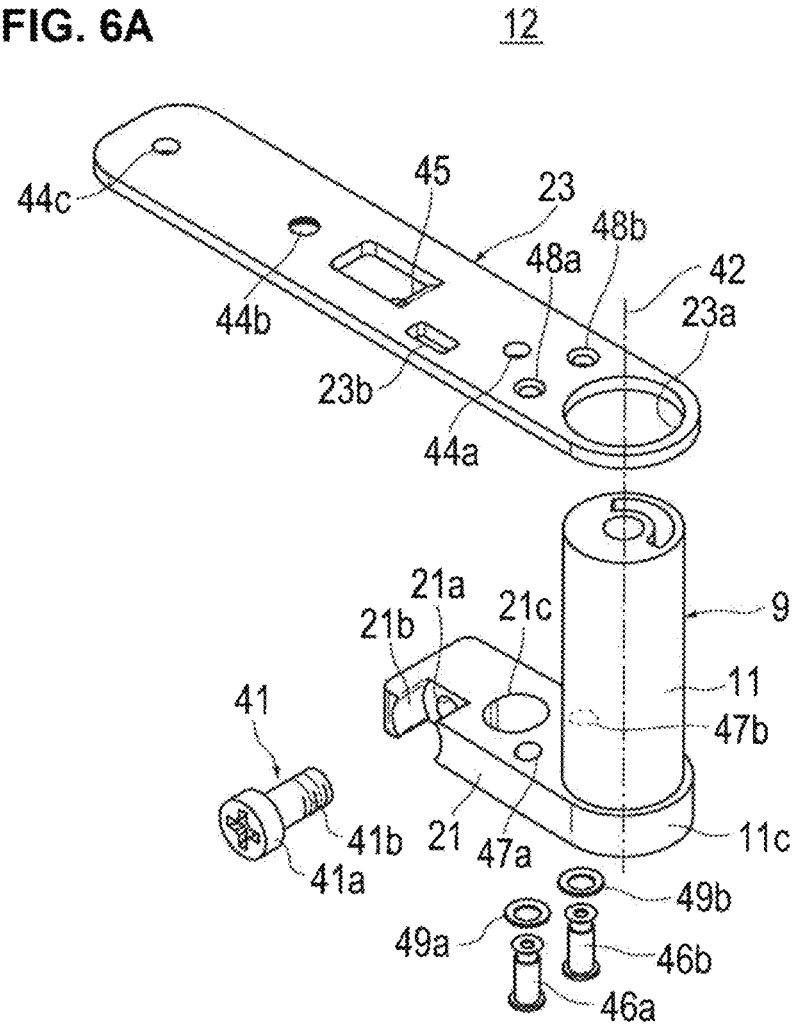
FIGS. 6A and 6B are an exploded perspective view of a positional adjustment structure, FIG. 6A being an exploded perspective view of the positional adjustment structure and FIG. 6B being a perspective view of the positional adjustment structure when assembled.

The case 9 comprises a cylindrical portion 11 and an extension portion 21 disposed in the lower end part of the cylindrical portion 11 to extend along the lower surface of the door 1, see FIG. 6A also. The cylindrical portion 11 and the extension portion 21 may be made of resin and integrally formed by molding or cutting. Reference numeral 12 denotes the positional adjustment structure. The details on the positional adjustment structure 12 will be described later.

The cylindrical portion 11 has its upper end part closed, see FIG. 2A, and its lower end part opened, see FIG. 3A. As shown in FIG. 2A, the cylindrical portion 11 has its upper end having an end wall 11*a* integrally formed. The end wall 11*a* is provided with an arc groove 11*b*. The groove 11*b* has its one end serving as a first contact section 31 that comes into contact with an arm 16*a* of the first spring holder 16. The first contact portion 31 is formed integral with the cylindrical portion 11 by molding, cutting or equivalent. The first contact portion 31 and the cylindrical portion 11 may be formed by a single member, which is not made integral by coupling separate members with adhesion or the like.

When the case 9 is in the neutral position P, the first contact section 31 is in contact with the arm 16*a* of the first spring holder 16. When the case 9 is rotated from the neutral position P in one direction (clockwise direction A) as shown in FIG. 2A, the first contact section 31 comes into contact with the arm 16*a* of the first spring holder 16 to thereby rotate the first spring holder 16 in the clockwise direction A. By contrast, when the case 9 is rotated from the neutral position P in the other direction (counterclockwise direction B) as shown in FIG. 2A, the first contact section 31 moves away from the arum 16*a* of the first spring holder 16, so that the first spring holder 16 is not rotated. The groove 11*b* has its other end 32 acting as a stopper for restricting the rotation of the case 9 by coming into contact with the arm 16*a* of the first spring holder 16 when the case 9 is rotated in the counterclockwise direction B by e.g. 90 degrees or more.

As shown in FIG. 3A, the cylindrical portion 11 has an open end 11*c* at the lower end part thereof which has its outer diameter enlarged to thereby support a base 23. On the open end 11*c*, the extension portion 21 is integrally formed. In addition, the open end 11*c* of the cylindrical portion 11 has a concave part 24 formed into an arc shape curving along the inner side of the cylindrical portion 11. The concave part 24 has its one side wall serving as a second contact section 25 that comes into contact with an arm 17*a* of the second spring holder 17. The second contact portion 25 is formed integral with the cylindrical portion 11 by molding, cutting or equivalent. The second contact portion 25 and the cylindrical portion 11 may also be formed by a single member, which is not made integral by coupling separate members with adhesion or the like.

When the case 9 is rotated from the neutral position P in the counterclockwise direction B as shown in FIG. 3A, the second contact section 25 comes into contact with the arm 17*a* of the second spring holder 17 so as to rotate the second spring holder 17 in the counterclockwise direction B. By contrast, when the case 9 is rotated from the neutral position P in the clockwise direction A as shown in FIG. 3A, the second contact section 25 moves away from the arm 17*a* of the second spring holder 17, and thus the second spring holder 17 is not rotated. The concave part 24 has another side wall 26 acting as a stopper for restricting the rotation of the case 9 by coming into contact with the arm 17*a* of the second spring holder 17 when the case 9 is rotated in the clockwise direction A by e.g. 90 degrees or more.

As shown in FIG. 2A, the first spring holder 16 is disposed to the upper end part of the coil spring 15. The first spring holder 16 comprises a ring-like main body portion 16*b* and the arm 16*a* protruding in the axial direction from the upper end surface of the main body portion 16*b*. The main body portion 16*b* and the arm 16*a* are formed integrally with each other. The main body portion 16*b* has its outer diameter almost equal to the inner diameter of the cylindrical portion 11, and has its inner diameter almost equal to the outer diameter of the shaft 27. The main body portion 16*b* is rotatable with respect to the cylindrical portion 11 and the shaft 27. When the first spring holder 16 is inserted into the cylindrical portion 11, the arm 16*a* enters the groove 11*b* and simultaneously protrudes outside the end wall 11*a* of the cylindrical portion 11. On the lower surface of the main body portion 16*b*, a hole 16*b*1 is formed for attaching the first spring holder 16 to the end of the coil spring 15, see FIG. 3A.

As shown in FIG. 3A, the second spring holder 17 is disposed to the lower end part of the coil spring 15. The second spring holder 17 comprises a ring-like main body portion 17*b* and the arm 17*a* provided on the lower end surface of the main body portion 17*b* and protruding in a radial direction from the main body portion 17*b*. The main body portion 17*b* and the arm 17*a* are formed integrally with each other. As with the first spring holder 16, the main body portion 17*b* has its outer diameter almost equal to the inner diameter of the cylindrical portion 11, while having its inner diameter almost equal to the outer diameter of the shaft 27. The main body portion 17*b* is rotatable with respect to the cylindrical portion 11 and the shaft 27. The arm 17*a* is in the form of a plate and disposed on the lower end surface of the main body portion 17*b*. When the second spring holder 17 is put into the open end 11*c* of the cylindrical portion 11, the tip of the arm 17*a* enters the concave part 24. On the upper surface of the main body portion 17*b*, a hole 17*b*1 is formed for attaching the second spring holder 17 to the end of the coil spring 15, see FIG. 2A.

The coil spring 15 is placed inside the cylindrical portion 11. The coil spring 15 has its opposite ends 15*a* and 15*b*, FIGS. 2 and 3, extending in the axial direction. The ends 15*a* and 15*b* of the coil spring 15 are attached to the first spring holder 16 and the second spring holder 17, respectively. The coil spring 15 is always twisted in its forward, twisting direction. More specifically, when the case 9 is rotated in the clockwise direction A from the neutral position P, the upper end part of the coil spring 15 is rotated in the clockwise direction A so that the coil spring 15 is twisted in the forward direction. When the case 9 is rotated in the counterclockwise direction B from the neutral position P, the lower end part of coil spring 15 is rotated in the counterclockwise direction B so that the coil spring 15 is twisted in the forward direction.

As shown in FIG. 2A, the shaft member 8 is fixed to the L-shaped washer 10 in anti-rotatable. The shaft member 8 comprises the shaft 27, a first engaging portion 18 and a second engaging portion 19. The shaft 27 is placed inside the coil spring 15. The first engaging portion 18 and the second engaging portion 19 are not integral with the shaft 27. The first engaging portion 18 and the second engaging portion 19 are fixed to the shaft 27 in anti-rotatable.

The shaft 27 extends in the vertical direction. The shaft 27 comprises a lower end part 27*a* having a larger diameter, an intermediate portion 27*b* and an upper end part 27*c* having a smaller diameter. The second engaging portion 19, a washer 20, the second spring holder 17, the coil spring 15 and the first spring holder 16 are put through the shaft 27, and the upper end part 27*c* of the shaft 27 in turn put through the first engaging portion 18 outside the end wall 11*a* of the case 9 to swage the upper end part 27*c* of the shaft 27, so as to fit those components into the case 9. Reference numeral 28 denotes a cap covering the first engaging portion 18.

The shaft 27 has its lower end part 27*a* generally oval-shaped in cross section and having a pair of parallel flat surfaces formed. The lower end part 27*a* of the shaft 27 is fitted into a hole of the washer 10 in anti-rotatable. The washer 10 has its hole having the shape of oval which is complementary to the lower end part 27*a* of the shaft 27. The upper end part 27*c* of the shaft 27 is also in the shape of oval in cross section. The upper end part 27*c* of the shaft 27 is fitted into a hole 18*a* of the first engaging portion 18 in anti-rotatable. The hole 18*a* is in the shape of oval which is complementary to the upper end part 27*c* of the shaft 27.

As shown in FIG. 2A, the first engaging portion 18 has an approximately discal shape. On the outer periphery of the first engaging portion 18, formed is an arc notch 18*b* having the size substantially equal to the arc groove 11*b* of the case 9. For this purpose, the first engaging portion 18 comprises an arc part 18-1 having a larger diameter and another arc part 18-2 having a smaller diameter. Outside the arc part 18-2, the arm 16*a* of the first spring holder 16 is located. When the case 9 is in the neutral position P, the arm 16*a* is in contact with one of shoulders 33 of the arc part 18-1.

The second engaging portion 19 comprises a main body part 19*a* and a flange 19*b* provided in the lower end part of the main body 19*a*. The main body part 19*a* has a V-shaped notch 34 formed therein. In the notch 34, the arm 17*a* of the second spring holder 17 is fitted. When the case 9 is in the neutral position P, the arm 17*a* comes into contact with one of side walls 35 of the main body part 19*a*.

As shown in FIG. 3A, the flange 19*b* is provided with an oval hole 19*b*1 complementary to the lower end part 27*a* of the shaft 27. In the hole 19*b*1, the lower end part 27*a* of the shaft 27 is fitted in anti-rotatable. In addition, in the bottom surface of the hole 19*b*1, formed is a through hole 19*b*2 through which the intermediate part 27*b* of the shaft 27 passes.

As shown in FIG. 2A, the flange 19*b* is provided with a V-shaped pointed cam 36 formed integrally. The cam 36 cooperates with the damper structure 13. The damper structure 13 generates a damper force when the door 1 returns to the neutral position P so as to allow the door 1 to close slowly. The configuration of the damper structure 13 will be described later.

The second engaging portion 19 is placed on the upper surface of the washer 10. On the upper surface of the flange 19*b* of the second engaging portion 19, the washer 20 made of a resin is mounted. The case 9 is rotatably supported on the second engaging portion 19 via the washer 20. The case 9 is guided in rotation by the second engaging portion 19, the first spring holder 16 and the second spring holder 17.

Figures 4A, 4B, 4C:
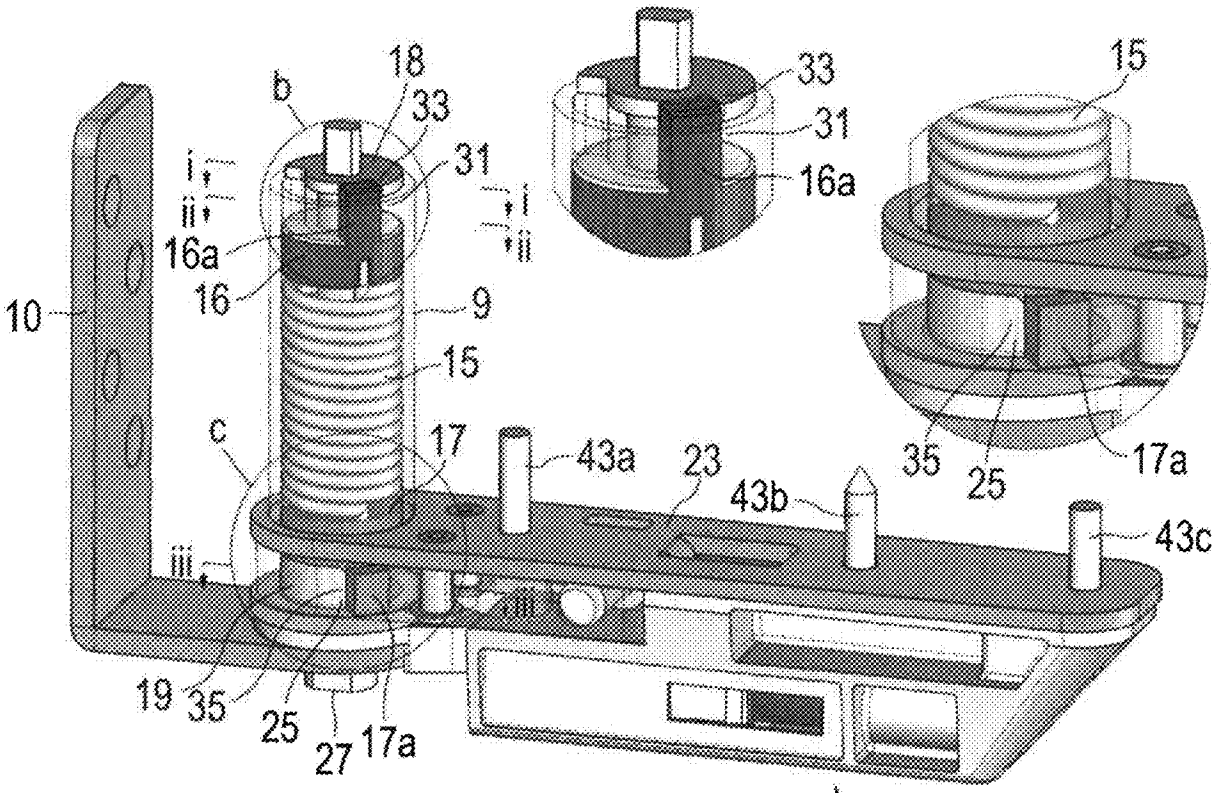
FIGS. 4A through 4C are a perspective view of the hinge device when assembled, FIG. 4A being an overall view, FIG. 4B being an enlarged view of the portion b shown in FIG. 4A, and FIG. 4C being an enlarged view of the portion c in FIG. 4A.

FIGS. 4A through 4C are a perspective view of the hinge device 3 in the neutral position P, FIG. 4A being an overall view, FIG. 4B being an enlarged view of the portion b in FIG. 4A, and FIG. 4C being an enlarged view of the portion c in FIG. 4A. In FIGS. 4A through 4C, the case 9 is illustrated transparently to clarify the internal structure of the case 9.

When the case 9 is in the neutral position P, the arm 16*a* of the first spring holder 16 at the upper end of the coil spring 15 comes into contact with one of the shoulders 33 of the first engaging portion 18 fixed to the shaft 27, and consequently the arm 17*a* of the second spring holder 17 at the lower end of the coil spring 15 comes into contact with one of the side walls 35 of the second engaging portion 19 fixed to the shaft 27. At this time, the first contact section 31 of the case 9 comes into contact with the arm 16*a* of the first spring holder 16, while the second contact section 25 of the case 9 comes into contact with the arm 17*a* of the second spring holder 17. In this case, the coil spring 15 is in the twisted state. Alternatively, the coil spring 15 can be in the normal state.

Figures 5A, 5B, 5C:
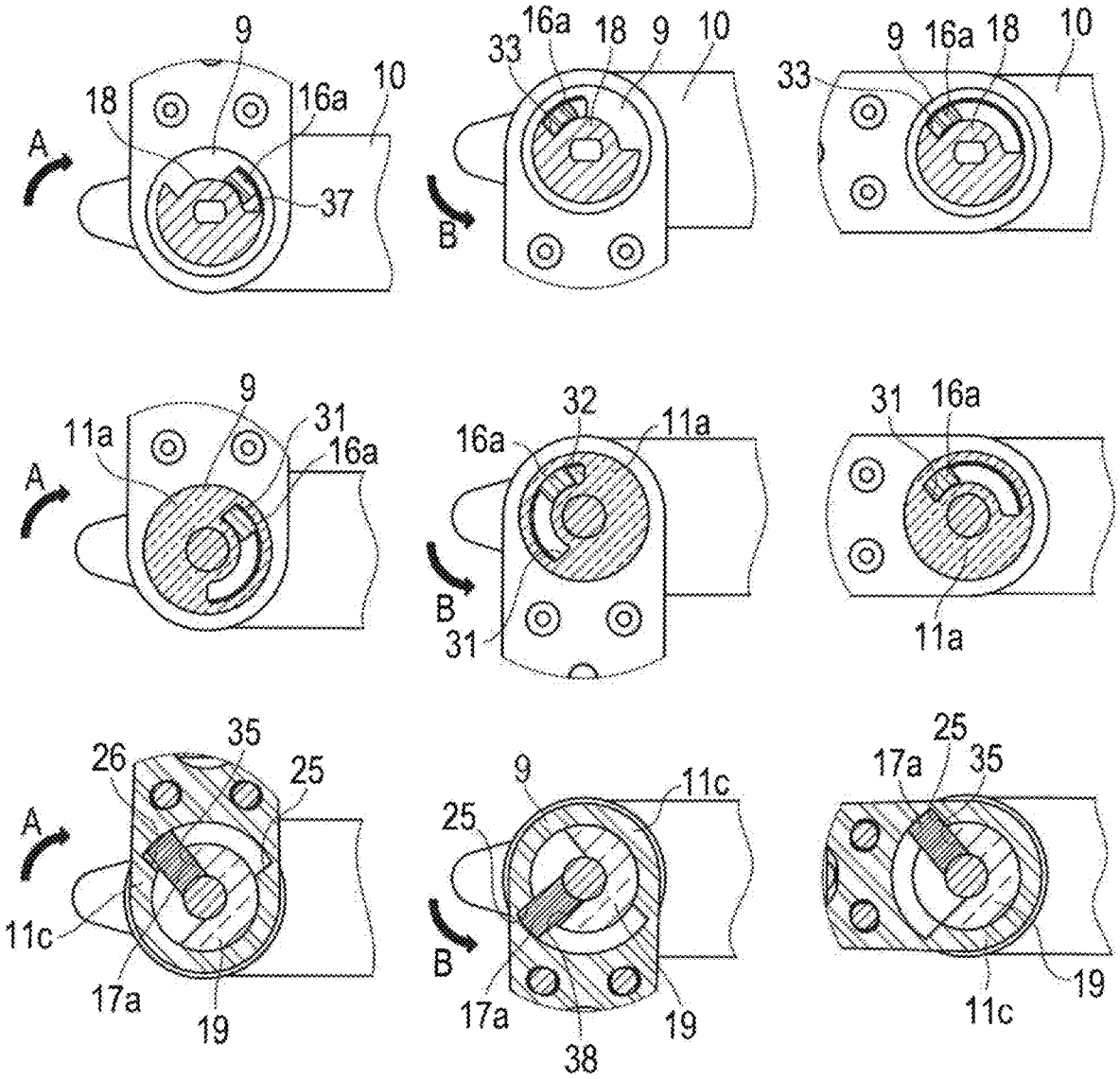
FIGS. 5A through 5C show an internal structure of the hinge device when a case is rotated clockwise and counterclockwise from its neutral position, FIG. 5A showing a state where the case is in its neutral position, FIG. 5B showing a state where the case is rotated counterclockwise, and FIG. 5C showing a state where the case is rotated clockwise.

FIGS. 5A through 5C show the internal structure of the hinge device 3 when the case 9 is rotated from the neutral position P in the clockwise direction A and counterclockwise direction B. FIG. 5A shows a state where the case 9 is in the neutral position P, FIG. 5B shows a state where the case 9 is rotated from the neutral position P in the counterclockwise direction B, and FIG. 5C shows a state where the case 9 is rotated from the neutral position P in the clockwise direction A. The top section of FIGS. 5A through 5C shows a horizontal cross sectional view of the first engaging portion 18 with a cross sectional view taken along i-i line in FIG. 4A, the middle section of FIGS. 5A through 5C shows a horizontal cross sectional view of the end wall 11*a* of the case 9 with a cross sectional view taken along ii-ii line in FIG. 4A, and the bottom section of FIGS. 5A through 5C shows a horizontal cross sectional view of the open end 11*c* of the case 9 and the second engaging portion 19 with the cross sectional view taken along iii-ii line in FIG. 4A.

When the case 9 is in the neutral position P, the arm 16*a* of the first spring holder 16 is, as shown in the top section of FIG. 5A, in contact with the shoulder 33 of the first engaging portion 18. As shown in the bottom section of FIG. 5A the arm 17*a* of the second spring holder 17 comes into contact with the side wall 35 of the second engaging portion 19. At this time, as shown in the middle section of FIG. 5A, the first contact section 31 of the case 9 is in contact with the arm 16*a* of the first spring holder 16, and as shown in the bottom section of FIG. 5A, the second contact section 25 of the case 9 is in contact with the arm 17*a* of the second spring holder 17.

When the case 9 is rotated from the neutral position P in the clockwise direction A, as shown in the middle section of FIG. 5*c*, the arm 16*a* of the first spring holder 16 abutting the first contact section 31 of the case 9 is rotated together with the case 9 in the clockwise direction A. As shown in the top section of FIG. 5C, the rotation in the clockwise direction A of the arm 16*a* of the first spring holder 16 is not blocked by the first engaging portion 18. By contrast, as shown in the bottom section of FIG. 5C, the second contact section 25 of the case 9 moves away from the arm 17*a* of the second spring holder 17, whereas the arm 17*a* of the second spring holder 17 remains in contact with the side wall 35 of the second engaging portion 19. As a consequence, the coil spring 15 is twisted, and thus a force in a direction where the coil spring 15 is untwisted, i.e. counterclockwise direction B, is exerted on the case 9. When the case 9 is released, the case 9 returns automatically to the neutral position P.

When the case 9 is rotated from the neutral position P in the clockwise direction A by 90 degrees or more, the arm 16*a* of the first spring holder 16 comes into contact with the shoulder 37 of the first engaging portion 18 as shown in the top section of FIG. 5C, or the side wall 26 of the case 9 comes into contact with the second spring holder 17 as shown in the bottom section of FIG. 5C, so as to restrict 90 degrees or more rotation of the case 9.

When the case 9 is rotated in the counterclockwise direction B, the arm 17*a* of the second spring holder 17 abutting the second contact section 25 of the case 9 is rotated along with the case 9 in the counterclockwise direction B, as shown in the bottom section of FIG. 5B. By contrast, the first contact section 31 of the case 9 moves away from the arm 16*a* of the first spring holder 16 as shown in the middle section of FIG. 5B, whereas the arm 16*a* of the first spring holder 16 remains in contact with the shoulder 33 of the first engaging portion 18. As a consequence, the coil spring 15 is twisted, and thus a force in a direction where the coil spring 15 is untwisted, i.e. clockwise direction A, is exerted on the case 9. When the case 9 is released, the case 9 returns automatically to the neutral position P.

When the case 9 is rotated from the neutral position P in the counterclockwise direction B by 90 degrees or more, the arm 17*a* of the second spring holder 17 comes into contact with the side wall 38 of the second engaging portion 19 as shown in the bottom section of FIG. 5B, or the other end 32 of the groove 11*b* of the case 9 comes into contact with the arm 16*a* of the first spring holder 16 as shown in the middle section of FIG. 5B, so as to restrict 90 degrees or more rotation of the case 9.

The configuration and the operation of the hinge device 3 according to the illustrative embodiment has been described above. The hinge device 3 of the present embodiment can produce the following advantageous effects.

Since the first contact portion 31 and the second contact portion 25 of the case 9 are formed integral with the cylindrical portion 11, the first contact portion 31 and the second contact portion 25 can be aligned property with each other. Thus, the case 9 in the neutral position can be prevented from rattling.

Since the first engaging portion 18 and the second engaging portion 19 of the shaft member 8 are formed separately from each other, the coil spring 15 can be fitted easily outside the shaft 27, and the diameter of the coil spring 15 can be made smaller. If the diameter of the coil spring 15 can be made smaller, the diameter of the cylindrical portion 11 of the case 9 can be made smaller correspondingly, and consequently the thickness of the door where the cylindrical portion 11 is inserted can be made thinner too.

As the coil spring 15 has its one end provided with the first spring holder 16 that comes into contact with the first contact portion 31 of the case 9, the coil spring can be twisted stably.

The coil spring 15 has its other end provided with the second spring holder 17 that comes into contact with the second contact portion 25 of the case 9, and thus the coil spring can be twisted stably.

The first spring holder 16 is provided with the arm 16*a* extending in the axial direction of the shaft 27, and the end wall 11*a* of the cylindrical portion 11 is provided with the groove 11*b* for inserting the arm 16*a* therein. Consequently, the diameter of the cylindrical portion 11 of the case 9 can be decreased. In addition, an end of the groove 11*b* can be used as the first contact portion 31.

The first engaging portion 18 is formed separately from the shaft 27 and is furthermore disposed outside the end wall 11*a* of the cylindrical portion 11, thereby facilitating the assemble of hinge device 3.

The second spring holder 17 is provided with the arm 17*a* extending in the radial direction of the shaft 27, and the open end 11*c* of the cylindrical portion 11 is provided with the concave part 24 for inserting the arm 17*a* therein, so that no end wall is required in the open end 11*c* of the cylindrical portion 11, and thus the components can be inserted from the open end 11*c*. In addition, the side wall of the concave part 24 can be used as the first contact portion 25.

Since the second spring holder 17 is disposed below the lower surface of the door 1, it is not necessary to increase the inner diameter of the hole 1*a* of the door 1 to conform with open end 11*c* of the cylindrical portion 11, and thus the door 1 into which the cylindrical portion 11 is inserted can be made thinner.

[Positional Adjustment Structure]

Figure 6B:
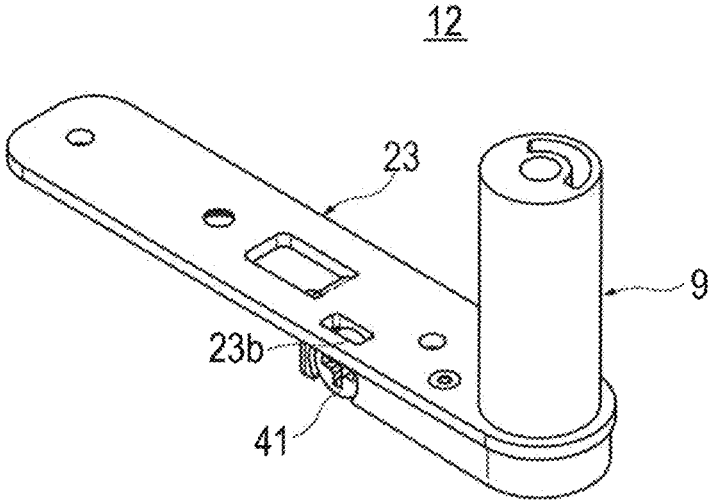

FIGS. 6A and 6B are a perspective view of the positional adjustment structure 12. FIG. 6A is an exploded perspective view of the positional adjustment structure 12, and FIG. 6B is a perspective view showing the positional adjustment structure 12 in an assembled state. Reference numeral 9 denotes the case, numeral 41 denotes a position adjusting screw as position adjusting member, and numeral 23 denotes the base.

As described above, the case 9 as a second member comprises the cylindrical portion 11 and the extension portion 21. The case 9 has its extension portion 21 formed integrally with the open end 11*c* of the cylindrical portion 11. The case 9 is rotatable about the rotation axis 42 with respect to the shaft member 8 as the first member.

The position adjusting screw 41 comprises a head 41*a* and a screw part 41*b*. The position adjusting screw 41 is oriented in a direction perpendicular to the rotation axis 42.

The extension portion 21 is provided with a screw hole 21*a* into which the position adjusting screw 41 is screwed. On the side surface of the extension portion 21, a notch 21*b* complementary to the head 41*a* of the position adjusting screw 41 is formed. The head 41*a* has its outer diameter greater than the thickness of the extension portion 21. The head 41*a* partially protrudes upward from the extension portion 21.

The base 23 has a substantially rectangular plate shape extending along the lower surface of the door 1. On one end in a length direction of the base 23, a round hole 23*a* is formed. The hole 23*a* has its diameter almost the same as the outer diameter of the cylindrical portion 11 of the case 9. The base 23 is rotatable about the rotation axis 42 of the case 9 with respect to the case 9.

The base 23 is provided with an approximately rectangular opening 23*b* into which the head 41*a* of the position adjusting screw 41 is inserted. The opening 23*b* of the base 23 has its edge engageable with the head 41*a* of the position adjusting screw 41. When the position adjusting screw 41 is turned by using a tool such as a screwdriver, the position adjusting screw 41 is moved in the axial direction with respect to the case 9, and thus the base 23 engaging with the head 41*a* swings clockwise and counterclockwise around the rotation axis 42.

On the base 23, through holes 44*a*, 44*b*, 44*c* are formed, through which fastening members 43*a*, 43*b* and 43*c*, FIG. 4A, are inserted for attaching the base 23 to the door 1. The fastening member 43*a* is a screw for attaching the base 23 to the door 1. An escaping hole 21*c* is formed in the extension portion 21 of the case 9 to avoid interference with the head of the fastening member 43*a*. The fastening member 43*b* is a flat-head screw for attaching the base 23 to the door 1. On the lower surface of the through hole 44*b* of the base 23, a conical countersunk hole 44*b*1 is formed for avoiding interference between the head of the fastening member 43*b* and the damper structure 13, see FIGS. 7A through 7C. The fastening member 43*c* is a screw for jointly fastening the base 23 and the damper structure 13 to the door 1. A through hole 51*a* is formed in a damper case 51 of the damper structure 13, through which the fastening member 43*c* passes, see FIG. 8. The base 23 is also provided with a bent piece 45 for positioning the damper case 51 of the damper structure 13.

As shown in FIGS. 6A and 6B, the case 9 and the base 23 are coupled to each other with coupling shafts 46*a* and 46*b* substantially parallel to the rotation axis 42. The case 9 has its extension portion 21 provided with elongate holes 47*a* and 47*b* through which the coupling shafts 46*a* and 46*b* pass, respectively. On the base 23, through holes 48*a* and 48*b* are formed for passing the coupling shafts 46*a* and 46*b* respectively therethrough. After the coupling shafts 46*a* and 46*b* pass through the elongate holes 47*a* and 47*b* of the case 9 and the through holes 48*a* and 48*b* of the base 23, respectively, the tips of the coupling shafts 46*a* and 46*b* are fixed to the base 23 by washers 49*a* and 49*b*, respectively. The base 23 can swing within the elongate holes 47*a* and 47*b* with respect to the case 9.

Figure 7A:
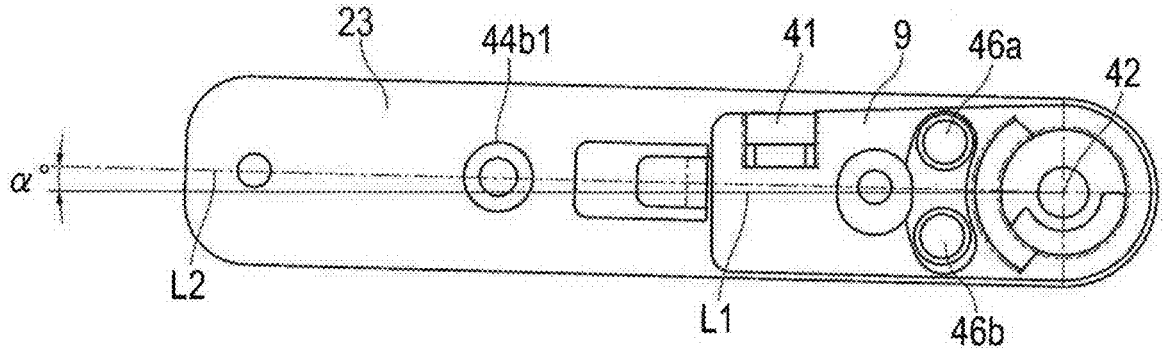
FIGS. 7A through 7B are a bottom view of the positional adjustment structure, FIG. 7A showing a state where a base is swung clockwise with respect to the case, FIG. 7B showing a state where a center line of the case is aligned with a center line of the base, and FIG. 7C showing a state where the base is swung counterclockwise with respect to the case.
Figure 7B:
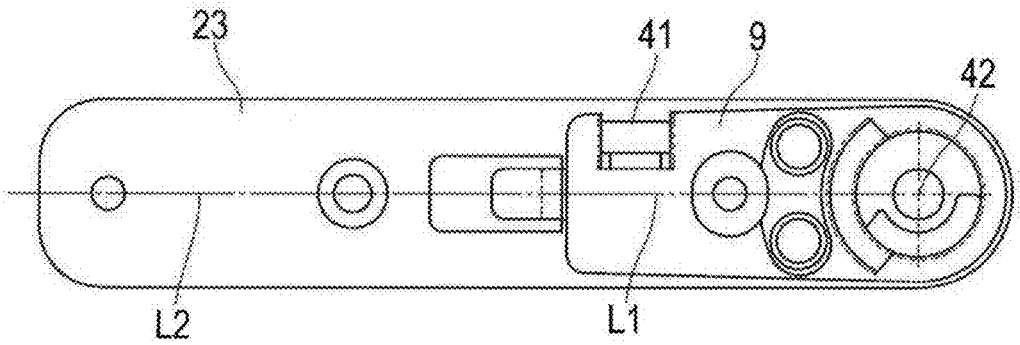
Figure 7C:
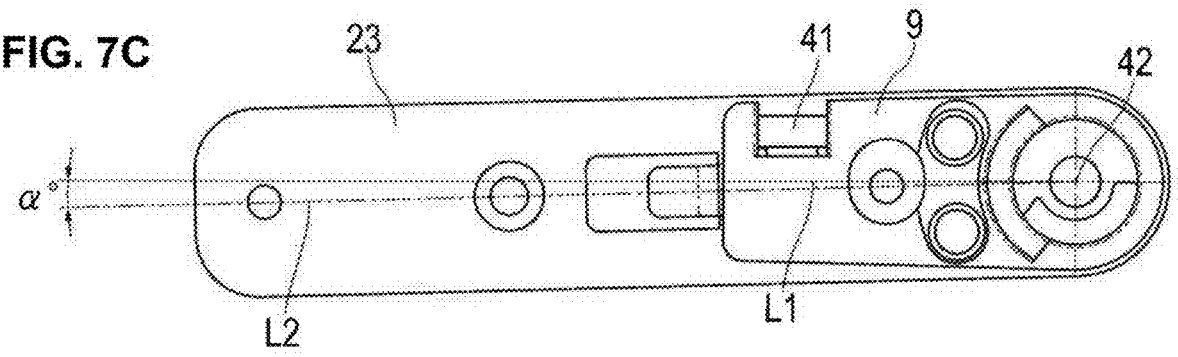

FIGS. 7A through 7C are a bottom view of the positional adjustment structure 12. FIG. 7B shows a state where a center line L1 of the case 9 is aligned with a center line L2 of the base 23, FIG. 7A shows a state where the position adjusting screw 41 is loosen to swing the case 23 clockwise with respect to the case 9, and FIG. 7C shows a state where the position adjusting screw 41 is tightened to swing the base 23 counterclockwise with respect to the case 9.

As described above, the base 23 can swing around the rotation axis 42 with respect to the case 9. In addition, the position adjusting screw 41 is bridged between them. Thus, when the position adjusting screw 41 is turned, an angle $\alpha$ formed between the case 9 and the base 23 about the rotation axis 42 can be adjusted, where a denotes an angle formed by the center line L1 of the case 9 and the center line L2 of the base 23. Since the door 1 is attached to the base 23, the position of the door 1 can be adjusted. Furthermore, as the position of the door 1 can be adjusted while confirming the position of the tip of the door 1 in the state where the door 1 is attached to the base 23, the positional adjustment of the door 1 can be conducted easily.

[Damper Structure]

Figure 8:
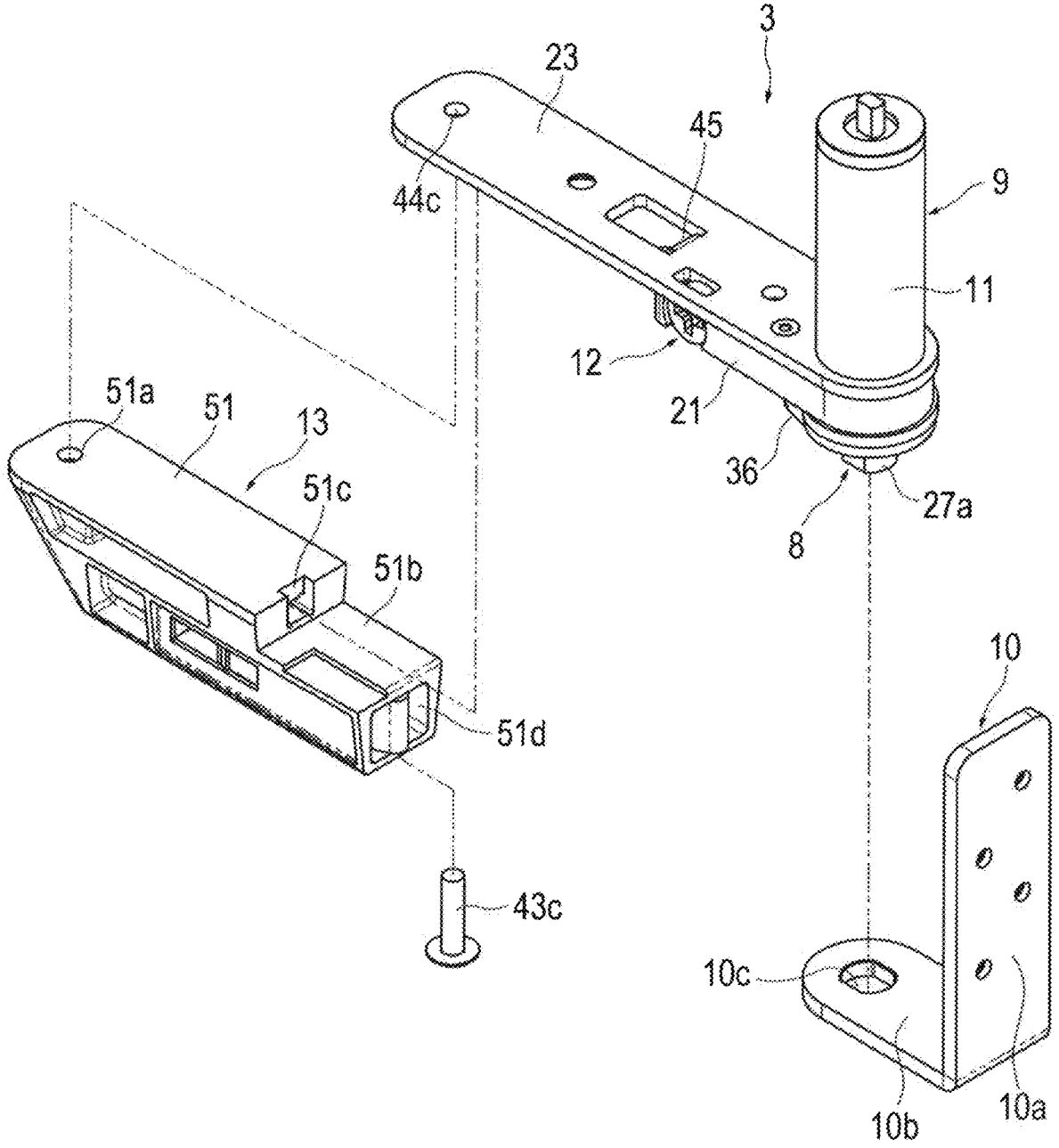
FIG. 8 is an exploded perspective view showing the hinge device, a damper structure and a washer.

FIG. 8 is an exploded perspective view showing the hinge device 3, the damper structure 13 and the washer 10. The washer 10 comprises a vertical portion 10*a* attached to the main body 6 and a horizontal portion 10*b*. To the horizontal portion 10*b*, the shaft member 8 is attached in anti-rotatable. In addition, a hole 10*c* is formed in the horizontal portion 10*b*, into which hole the lower end part 27*a* of the shaft member 8 is inserted in anti-rotatable. The hole 10*c* is of the shape of oval which is complementary to the lower end part 27*a* of the shaft member 8. The shaft member 8 is provided with the cam 36.

Figure 9:
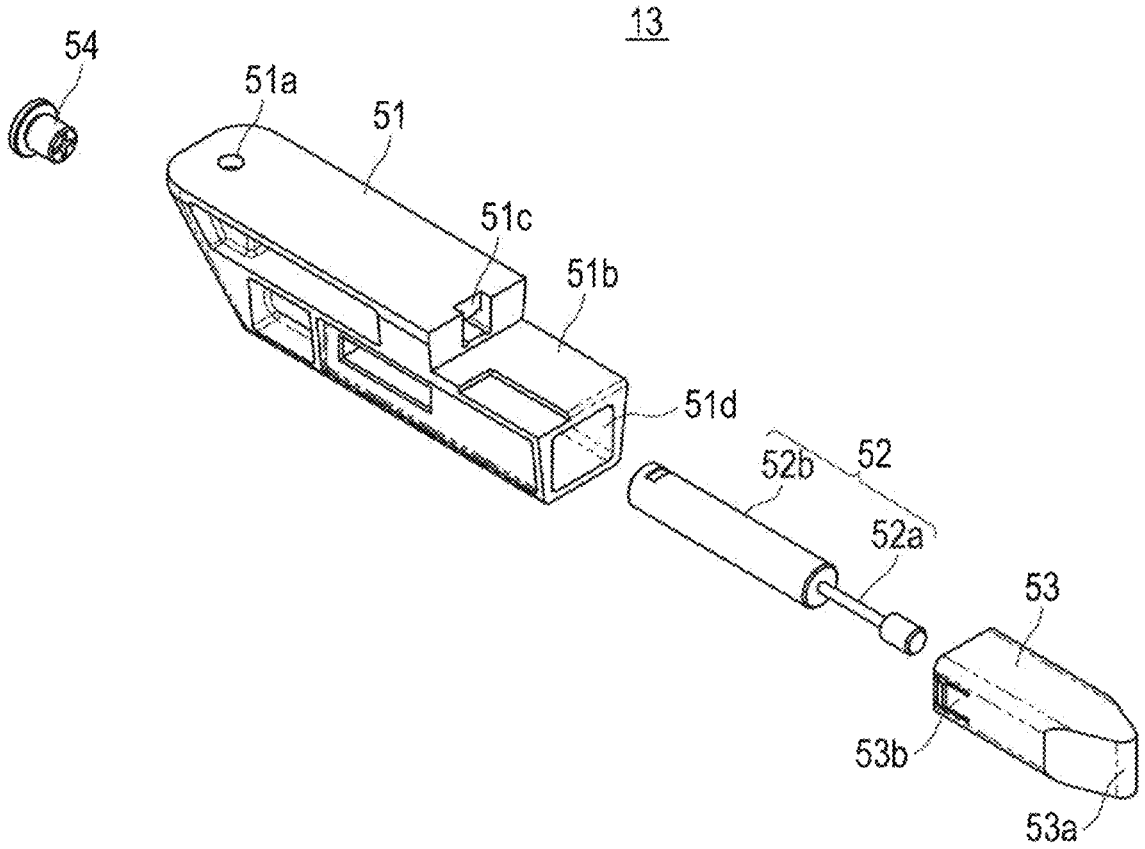
FIG. 9 is an exploded perspective view of the damper structure.

FIG. 9 is an exploded perspective view of the damper structure 13. The damper structure 13 comprises the damper case 51, the linear damper 52 and a slider 53. The damper case 51 has an approximately rectangular parallelepiped shape extending along the lower surface of the door 1. A holding space 51*d* for the linear damper 52 is formed in the damper case 51. On the upper part of the damper case 51, a step 51*b* for avoiding interference with the extension portion 21 of the case 9, FIG. 8, is formed.

As shown in FIG. 8, the damper case 51 is attached to the lower surface of the base 23 by means of the fastening member 43*c*. The base 23 is attached to the lower surface of the door 1 by means of the fastening members 43*a*, 43*b*, see FIG. 4A On one end of the damper case 51, formed is a hole 51*a* for passing the fastening member 43*c* therethrough. A concave part 51*c*, in which the bent piece 45 of the base 23 is fitted, is formed in the shoulder of the damper case 51 in order to position the damper case 51 with respect to the base 23.

As shown in FIG. 9, the slider 53 is slidably fitted into the holding space 51*d* of the damper case 51. The slider 53 is in a square cylindrical form. The slider 53 has its tip provided with a V-shaped convex part 53*a*. Reference numeral 53*b* denotes a stopper for the slider 53.

The linear damper 52 comprises a main body 52*b* and a rod 52*a* which is movable to the main body 52*b*. A return spring, not shown, for returning the linear damper 52 to an extended state is incorporated in the main body 52*b*. Furthermore, the main body 52*b* is filled with a viscous fluid. The rod 52*a* has its base end provided with a piston moving inside the main body 52*b*. The movement of the piston inside the main body 52*b* produces a damper force.

The linear damper 52 resides between the slider 53 and the damper case 51. Into the damper case 51, a position adjusting screw 54 for adjusting the position of the linear damper 52 is screwed. The position adjusting screw 54 has its tip rendered in contact with the linear damper 52. When the position adjusting screw 54 is turned, the linear damper 52 is adjusted in position, and as a consequence the damper force is adjusted.

Figure 10A:
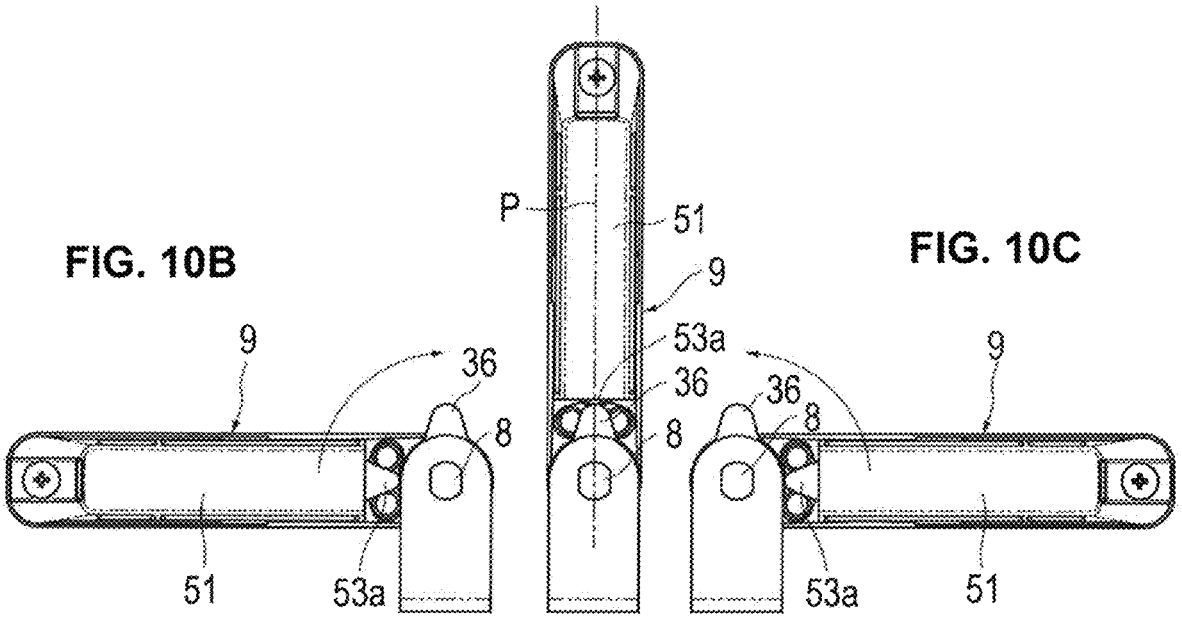
Figure 11:
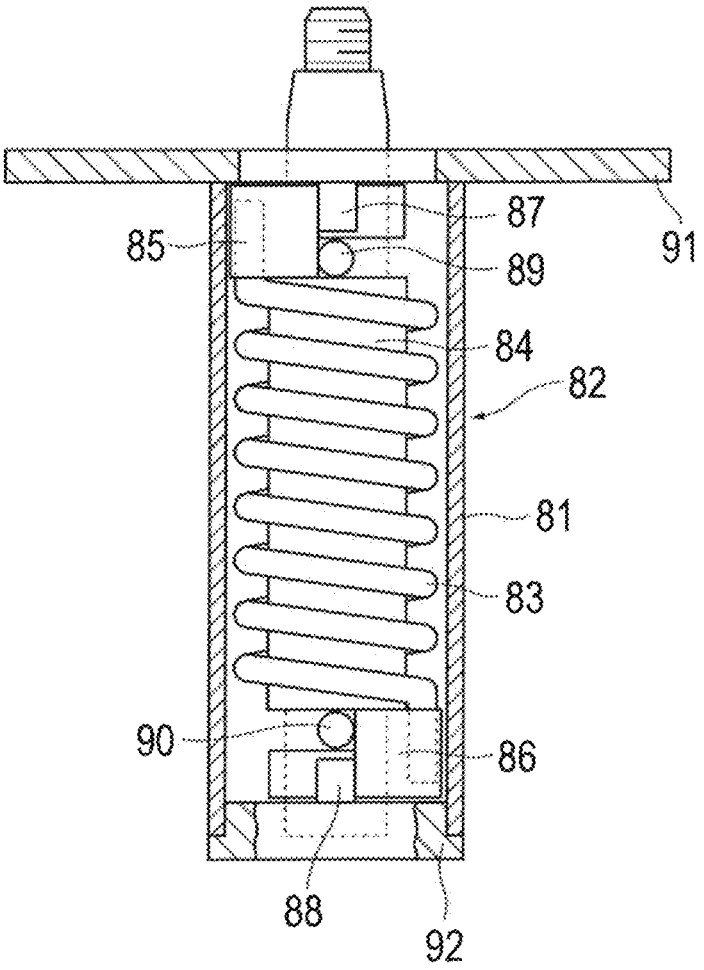
FIG. 11 is a cross-sectional view of a conventional hinge device.

FIGS. 10A through 10C are a bottom view of the hinge device 3 useful for understanding an operation of the damper structure 13. FIG. 10A shows the neutral position P of the case 9, FIG. 10B shows a state where the case 9 is rotated from the neutral position P in the counterclockwise direction (direction A in FIG. 2A) by about 90 degrees, and FIG. 10C shows a state where the case 9 is rotated from the neutral position P in the clockwise direction (direction B in FIG. 2A) by about 90 degrees.

The case 9 rotated clockwise and counterclockwise from the neutral position P is applied with the urging force for returning the case back to the neutral position P by the coil spring 15, see FIG. 2A. The case 9 is then rotated about the shaft member 8 to automatically return to the neutral position P. At this time, the linear damper 52 is held in the damper case 51 and is rotated about the shaft member 8 together with the case 9. The linear damper 52 is always oriented in the direction of the shaft member 8.

When the case 9 returns to the neutral position P, the cam 36 of the shaft member 8 comes into contact with the convex part 53*a* of the slider 53, and thus the slider 53 is pushed into the damper case 51. As a consequence, the linear damper 52 is compressed to generate a damper force in the linear damper 52, thereby allowing the case 9 to slowly return to the neutral position P.

It is to be noted that the present invention is not limited to the embodiment described above, but various embodiments may be implemented without changing the gist of the invention. It is to be appreciated that those skilled in the art can change or modify the embodiments without departing from the scope and spirit of the present invention.

Although the first and second engaging portions are formed separately from the shaft in the illustrative embodiment, either one of the first and second engaging portions may be integrated with the shaft.

Although the illustrative embodiment is adapted to rotate the case from the neutral position, the shaft member may be adapted to be rotatable from the neutral position.

In the illustrative embodiment, the hinge device is disposed on the lower part of the door and the second spring holder is disposed below the lower surface of the door. Alternatively, the hinge device may be disposed on the upper part of the door and the second spring holder may be disposed above the upper surface of the door.

The configuration of the components of the hinge device according to the above embodiment is merely exemplified, and thus other configurations may be employed without changing the gist of the invention.

What is claimed is:

1. A hinge device, comprising:

a case having a first contact portion, a second contact portion and a cylindrical portion;

a coil spring fitted in the cylindrical portion of the case;

a shaft member having a shaft inserted inside the coil spring, and a first engaging portion and a second engaging portion fixed to the shaft in anti-rotatable; wherein when the case is rotated relatively from a neutral position in one direction with respect to the shaft member, one end of the coil spring in contact with the first contact portion of the case is rotated relatively in the one direction with respect to the shaft member, while another end of the coil spring comes into contact with the second engaging portion of the shaft member, thereby twisting the coil spring;

when the case is rotated relatively from the neutral position in the other direction with respect to the shaft member, the other end of the coil spring in contact with the second contact portion of the case is rotated relatively in the other direction with respect to the shaft member, while the one end of the coil spring comes into contact with the first engaging portion of the shaft member, thereby twisting the coil spring; and the first and second contact portions are formed integral with the cylindrical portion;

wherein the one end of the coil spring is provided with a first spring holder that comes into contact with the first contact portion of the case;

wherein the first spring holder has an arm extending in an axial direction of the shaft, and the cylindrical portion has an end wall provided with a groove into which the arm of the first spring holder enters.

2. The hinge device in accordance with claim 1, wherein the first engaging portion is formed separately from the shaft and disposed outside the end wall of the cylindrical portion.

3. The hinge device in accordance with claim 1, wherein the second spring holder has an arm extending in a radial direction of the shaft, and the cylindrical portion has an open end provided with a concave part into which the arm of the second spring holder enters.

4. The hinge device in accordance with claim 3, wherein the cylindrical portion extends in a vertical direction while the cylindrical portion is partly inserted into a hole formed in the door, and the second spring holder is disposed below a lower surface of the door or above an upper surface of the door.

* * * * *